US005357230A

United States Patent [19]

Mikawa

[11] Patent Number: 5,357,230

[45] Date of Patent: Oct. 18, 1994

[54] ELECTROMAGNETIC RELAY

[75] Inventor: Shoichi Mikawa, Kumamoto, Japan

[73] Assignee: OMRON Corporation, Kyoto, Japan

[21] Appl. No.: 147,444

[22] Filed: Nov. 5, 1993

Related U.S. Application Data

[63] Continuation of Ser. No. 28,501, Mar. 9, 1993, abandoned.

[30] Foreign Application Priority Data

Mar. 27, 1992 [JP] Japan ..... 4-070797

[51] Int. Cl.[5] ..... H01H 51/22

[52] U.S. Cl. ..... 335/78; 335/80; 335/128

[58] Field of Search ..... 335/78-86, 335/124, 128, 131, 132

[56] References Cited

U.S. PATENT DOCUMENTS 5,117,209 5/1992 Sato ..... 335/80

FOREIGN PATENT DOCUMENTS 0437209 7/1991 European Pat. Off. .
2-7323 1/1990 Japan .
2-33821 2/1990 Japan .

*Primary Examiner*—Lincoln Donovan
*Attorney, Agent, or Firm*—Fish & Richardson

[57] ABSTRACT

An electromagnetic relay in which a movable block is mounted on an upper surface of an electromagnetic block disposed on a base for a swing movement and contacts are switched by the movable block driven by the movable block being energized and deenergized, a pair of supports projecting on an upper surface of the base which are opposed with respect to the electromagnetic block, a pair of shafts coaxially projecting from both opposite side walls of the movable block are engaged from the upward with concave portions formed on upper surfaces of the supports to be supported thereby, and a load spring at one end is fixed to the movable block but at other end is contactable with a stationary portion.

9 Claims, 14 Drawing Sheets

ELECTROMAGNETIC RELAY

This application is a continuation of U.S. application Ser. No. 08/028,501, filed Mar. 9,1993, now abandoned.

BACKGROUND OF THE INVENTION

1. Field of the Invention

This invention relates to an electromagnetic relay, and more particularly an improved electromagnetic relay for switching contacts through a seesaw movable block.

2. Discussion of the Related Art

An example of conventional electromagnetic relay is disclosed in the Japanese Laid-open patent publication No. Hei 2-033821. As shown in FIGS. 13 and 14, the conventional relay includes a base 1 having a H-shaped section and a separating wall 11 separating an inner chamber into upper and lower chambers. An electromagnetic block 2 is placed into the base from the downward to swing an armature block 3 placed into the base from the upward for switching contacts by energizing and deenergizing electromagnetic block 2. In FIG. 14, armature block 3 is supported by a pair of leads 34 representing supporting shafts for a swingable movement by respectively welding both wings 35 of a pair of contact connecting leads 33 of plane T-shaped configuration together with contacts 12*a* of a pair of common terminals 12 which appear through a central portion of upper end surfaces in open peripherals of base 1. This construction has a problem that when an external impact is applied to the relay, the above-mentioned leads 34 is brought into plastic deformation to extremely change its operation characteristics or to sometimes invite inoperable state.

Moreover, the armature block 3 needs many assembling processes taking time because the both wings 35 of contact connection leads 33 have to be respectively welded with contacts 12*a* of the common terminals 12.

Welding the contact connecting leads 33 with the common terminals 12 as a single unit provides assembling accuracy with dispersion. Accordingly there are problems that the operation characteristics are apt to be dispersed and the adjustment work of operation characteristics is troublesome due to unification of base 1 and armature 3.

SUMMARY OF THE INVENTION

It is therefore a primary of this invention to provide an electromagnetic relay which has a strong resistibility against mechanical impact, a high productivity, and a simple adjustment work requirement.

According to this invention there is provided an electromagnetic relay in which a movable block is mounted on an upper surface of an electromagnetic block disposed on a base for a swing movement and contacts are switched by the movable block driven by the movable block being energized or deenergized, a pair of supports projecting on an upper surface of the base which are opposed with respect to the electromagnetic block, a pair of shafts coaxially projecting from both opposite side walls of the movable block are engaged from the upward with concave portions formed on upper surfaces of the supports to be supported thereby, and a load spring at one end is fixed to the movable block but at the other end is contactable with a stationary portion.

The load spring may be so designed that one end thereof is fixed to the movable block and the other end thereof has a pair of elastic arms extending therefrom in opposite or confront directions. Moreover, the load spring may be designed to subsequently contact a plurality of projections different in height which project from the stationary portion or to subsequently contact bent upper end surface of projection standing on upper surface of the above-mentioned stationary portion.

The load spring also may be so designed that the other end thereof consists of divisional leads divided in a width direction, the respective divisional leads subsequently contacting heads of projections having steps projecting on the upper surface of the stationary portion, or that the elastic arms are in double at least at the base ends thereof.

Thus, according to this invention, external impact is received by a pair of shafts disposed on the movable block, so that any over impact load is not applied to the load spring and plastic deformation of the load spring is prevented.

BRIEF DESCRIPTION OF THE DRAWINGS

Other objectives and advantages of this invention will be more readily apparent from the following detailed description provided in conjunction with the following figures, of which.

DETAILED DESCRIPTION OF THE INVENTION

Figure 1:
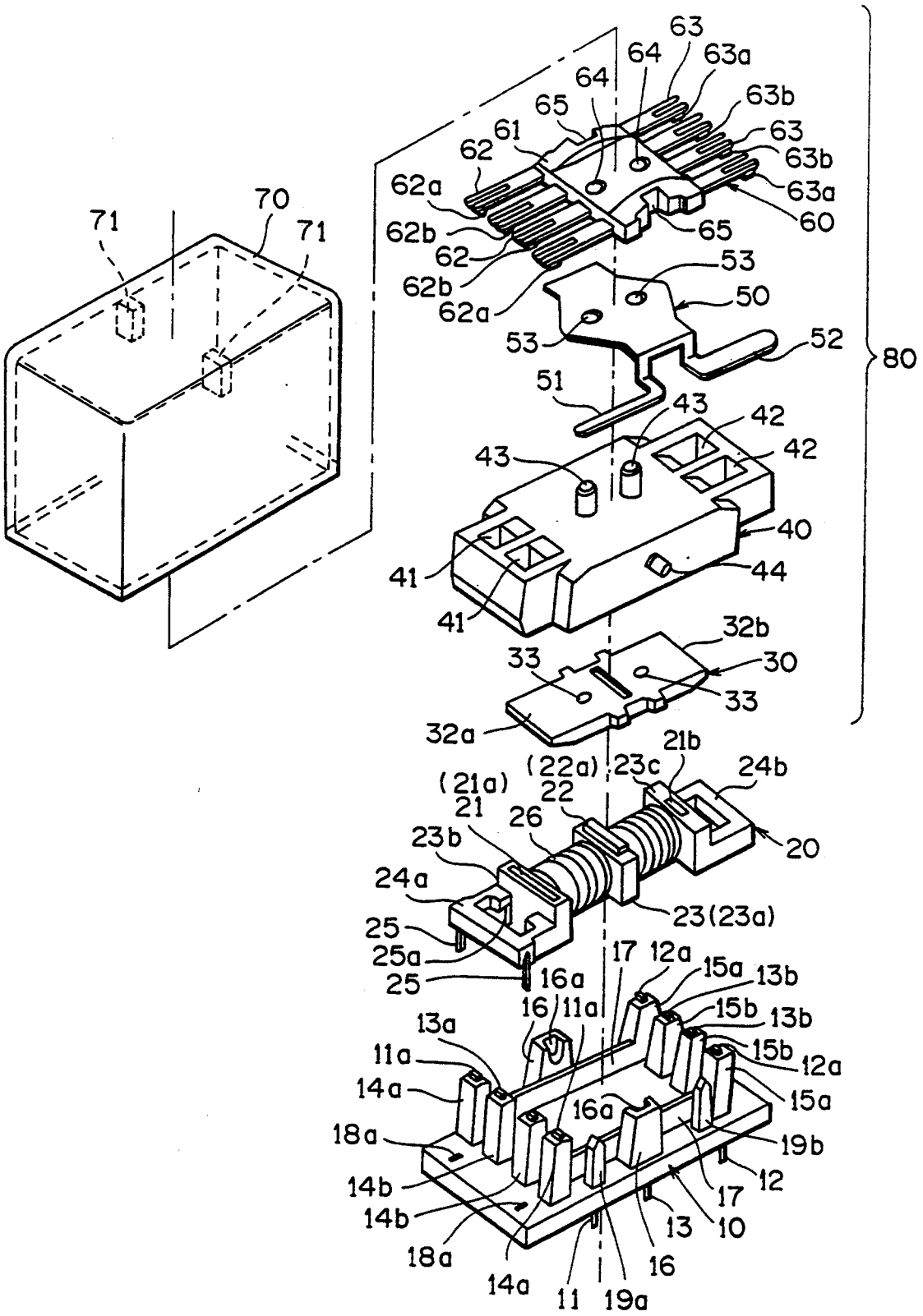
FIG. 1 is a slant disassembled perspective view of an electromagnetic relay as a first embodiment of this invention.
Figure 2:
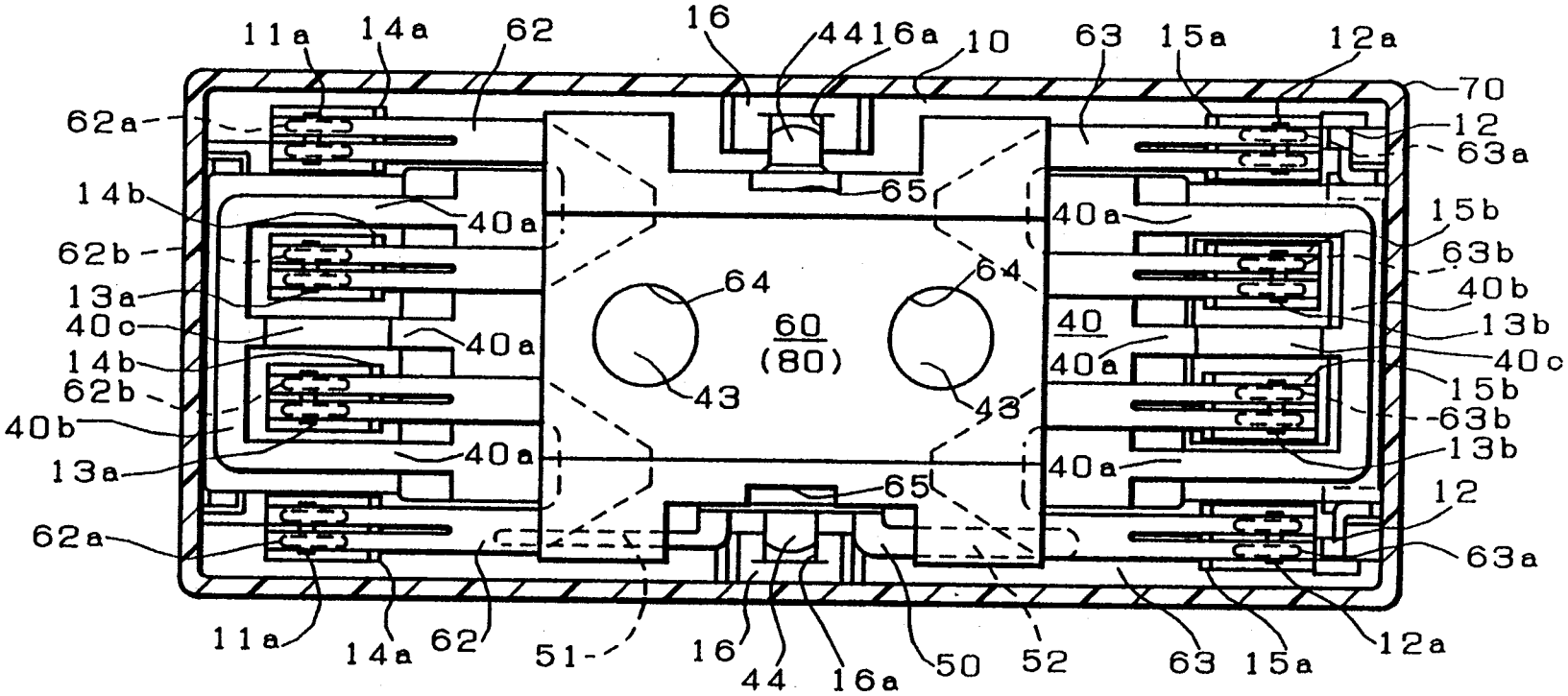
FIG. 2 is a plane sectional view of the relay of FIG. 1.
Figure 3:
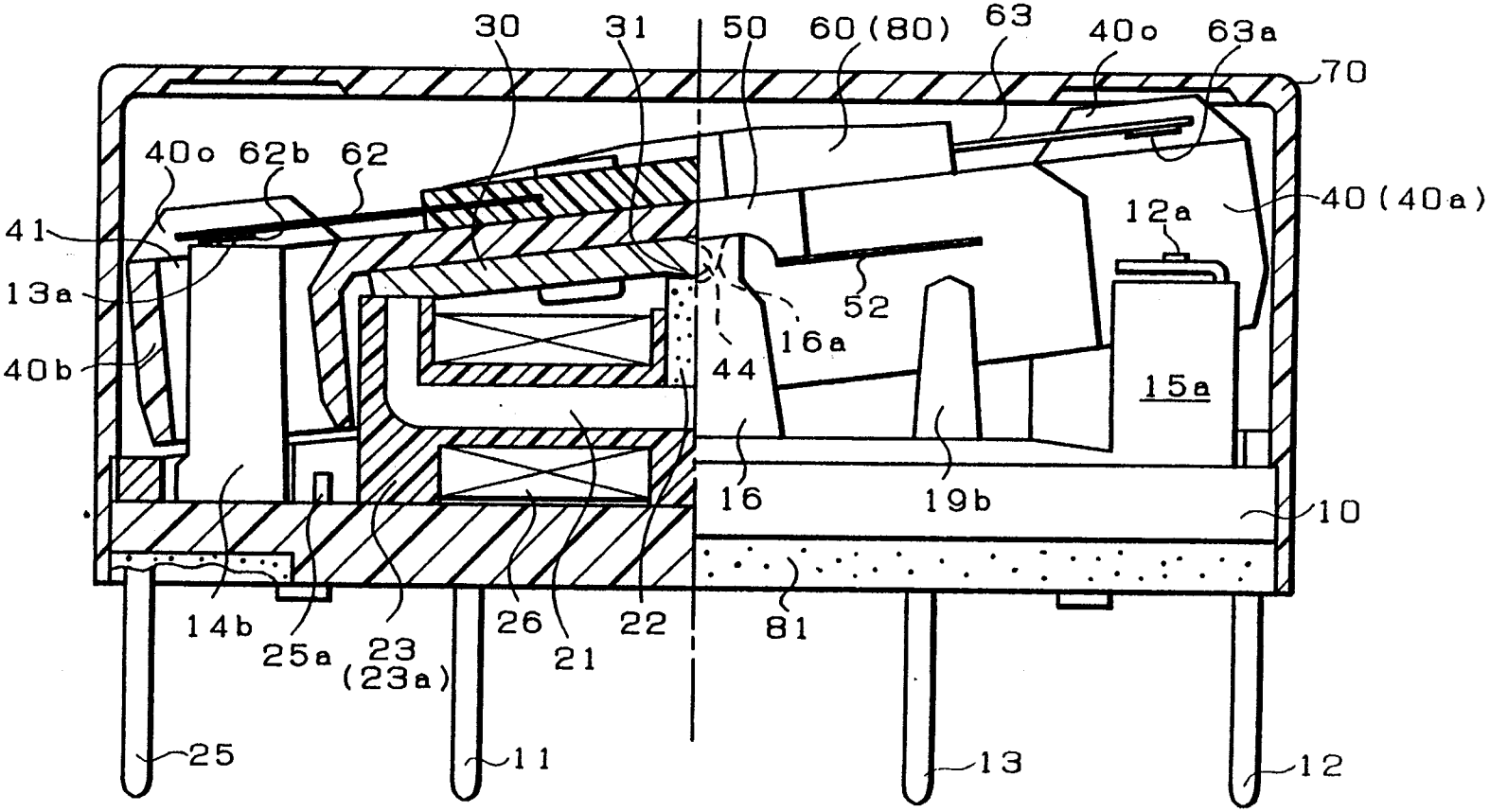
FIG. 3 is a front sectional view of the relay of FIG. 1.

In FIGS. 1 to 3 there is shown an electromagnetic relay as a first embodiment of this invention which includes a base 10, an electromagnetic block 20, a movable block 80 consisting of a movable iron blade 30, an insulator 40, a load spring 50 and movable contact blade block 60, and a housing 70.

The base 10 has a plane rectangular configuration, and is an insert-mold symmetrically inserted by two pairs of stationary contact terminals 11 and common contact terminals 13 and press-fitted by a pair of stationary contact terminals 12 from the upward (the respective inner contact terminals are not shown in FIG. 1).

Four supports 14a, 14b, 14b, 14a and four supports 15a, 15b, 15b, 15a are opposite projections near the short side ends of the base, and a pair of supports 16 for fixing positions are projected at a middle position between supports 14a and 15a.

In viewer's side of the base 1 there are provided a pair of spring receiving projections 19a and 19b respectively located between supports 16 and 14a and between supports 16 and 15a. The projections 16 at upper end surfaces thereof are provided with shaft supporting concave portions 16a.

Upper ends of the stationary contact terminals 11 are electrically connected through lead frames (not shown in drawings) with stationary contacts 11a disposed on upper end surfaces of supports 14a, and upper ends of the stationary contact terminals 12 are also electrically connected through lead frames (not shown) with stationary contacts 12a disposed on upper end surfaces of supports 15a.

Common contact terminals 13 at upper ends thereof are divided into two portions, one ends being electrically connected through lead frames (not shown) with stationary contacts 13a disposed on upper end surfaces of supports 14b and the other ends electrically connected through lead frames (not shown) with stationary contacts 13b disposed on upper end surfaces of supports 15b.

A pair of insulating walls 17 are respectively disposed between supports 14a and 15a on both sides of the base. 18a represent coil terminals.

The electromagnetic block 20 includes a spool 23 insert-molded by a component having an E-shaped sectional configuration formed by arranging a permanent magnet 22 on an iron core 21 of a staple-shaped sectional configuration, in which a magnetic pole 22a of permanent magnet 22 is exposed through an upper face of a central flange 23a, a left-hand side magnetic pole 21a of iron core 21 is exposed through an upper surface of a flange 23b of spool 23, and a right-hand side magnetic pole 21b of iron core 21 is exposed through an upper surface of a flange 23c of spool 23.

Frames 24a and 24b are molded with external sides of the flanges 23b and 23c as a single unit, and the frame 24a is inserted by a pair of coil terminals 25. Leads of a coil 26 wound on the spool 23 are wrapped around wrapping portions 25a (viewer's side wrapping portion is not shown) of coil terminals 25 and soldered. The wrapping portions 25a of this embodiment are projecting inwardly within frame 24a, so that any obstacles in assembling electromagnetic block 20 is not produced.

Though the iron core 21 is constant in thickness, the left-hand side magnetic pole 21a is wider than the right-hand side magnetic pole 21b to have a broad attraction area and break a magnetic balance between both poles. As electromagnetic block 20 is fixed above base 10 and coil terminals 25 are press-fitted into coil terminal holes 18a for temporal connection, supports 14b and 15b come out through frames 24a and 24b.

The movable iron blade 30 has a plane rectangular configuration and constitutes the movable block 80 with insulating frame 40, load spring 50 and movable contact blade block 60. The blade 30 has a projection 31 (FIG. 3) projecting downwardly from a lower surface thereof to serve as a swing supporting point, and tapered surfaces on a lower wall of end portions 32a and 32b. A pair of calking openings 33 opposing about projection 31 are provided in the blade 30.

The insulating frame 40 has a box-shaped configuration for housing movable iron blade 30, receiving holes 41 and 42 in end portions thereof for receiving supports 14a and 15b of base 10, calking projections (not shown in drawings) at the positions corresponding to calking openings 33 of blade 30, a pair of projections calking projections 43 on an upper wall thereof, and a pair of shaft 44 projecting at central portions of opposite side walls thereof.

The frame 40 is jointed together with the iron blade 30 by piercing the calking projections (not shown) through calking openings 33 of blade 30 to be thermally calked.

In this embodiment the insulating frame 40 has a high insulation by respectively separating stationary contacts 11a and 13a; 12a and 13b by blades 40a (FIG. 2) disposed in a comb teeth fashion which present receiving holes 41(42). End portions of separating blades 40a are jointed together with joint portions 40b as a single unit, so that the insulating frame 40 is hard to be deformed. The joint portions 40b may be omitted if it is a sole purpose to obtain a predetermined insulation characteristic. Moreover, a long insulation distance and improved insulation characteristic is obtained because the insulating frame 40 separates electromagnetic block 20 and movable iron blade 30 from movable contact blades 62 and 63 and stationary contacts 13a and 13b. In particular, insulation characteristic after operation is improved because projections 40c (FIGS. 2 and 3 ) disposed on upper surfaces of separating blades 40a separate the respective two neighbor stationary contacts 13a and 13b.

Load spring 50 is a bent component stamped out from an elastic plate, which includes a pair of elastic arms 51 and 52 extending in an opposite direction to be contacted with the coil receiving projections 19a and 19b of base 10 and calking openings 53 at the positions corresponding to calking projections 43 of frame 40. Arm 52 is wider than arm 51.

The movable contact blade block 60 (FIG. 2) is a insert mold inserted by two pairs of U-shaped blades 62 and 63 across an insulating base 61 of block 60. A pair of calking openings 64 are formed at a middle position of the insulating base 61 to correspond to calking projections 43 of frame 40. Each of the above-mentioned movable contact blades 62 at its end portions is divided into two blades in a width direction, one end on a lower surface carrying movable contacts 62a and other end on a lower surface thereof carrying movable contacts 62b. Each of movable contact blades 63 also has a same construction as that of movable contact blades 62, and on its lower surfaces carries movable contacts 63a and 63b.

Projections 43 of the insulating frame 40 pierce calking openings 53 of load spring 50 and calking openings 64 of insulating base 61 to be thermally calked for building movable block 80 with insulating frame 40 uniting movable iron blade 30 as a single body, load spring 50 and movable contact blade block 60.

The movable block 80 is positioned above base 10 and shafts 44 of insulating frame 40 are engaged with concave portions 16a of supports 16 of base 10, so that the magnetic pole 22a of permanent magnet 22 comes into contact with projection 31 of movable iron blade 30 to support blade 30 for a swing movement and movable contacts 62a, 62b, 63a and 63b confront to stationary contacts 11a, 13a, 12a and 13b in a contact and separated relationship. In thus assembled construction (FIG.

3), a surface of magnetic pole of permanent magnet 22, projection 31 of movable iron blade 30 and hinge spring 54 are positioned in a same plane, so that unnecessary bending moment is not applied and a smooth movement is ensured.

In this embodiment movable contacts 62*a*, 62*b*, 63*a* and 63*b* are in a forward position as to end portions 32*a* and 32*b* of movable iron blade 30 so that revolution radiuses movable contact blades 62 and 63 are long. Accordingly even if a revolution angle of movable iron blade 30 is small, sufficient switching of contacts is ensured. As a result, there is provided the electromagnetic relay which is high sensitive and has a reduced power consumption and large contact gaps. Housing 70 has a box-shaped configuration mountable on the base 10 and on inner corners thereof projections 71 for limiting position. As base 10 is inserted into housing 70, projections 71 are engaged with cut concave portions 65 to limit moving up of the movable block 80. Nextly a seal material 81 seals an concave formed by insertion of base 10 to housing 70, inner gas is exhausted through a gas vent opening (not shown in drawings) in the base 10, and the gas vent opening is thermally soldered to be sealed after the gas exhaustion to complete assembling operation of the relay.

An operation of the electromagnetic relay having the above-mentioned construction will be described. In deenergization state the left-hand side end 32*a* of movable iron blade 30 is attracted to left-hand side wide magnetic pole 21*a* of iron core 21 by magnetic fluxes of permanent magnet 22 to close a magnetic circuit (FIG. 3). Then movable contacts 62*a* and 62*b* of movable contact blade 62 are in contact with stationary contacts 11*a* and 13*a*, movable contacts 63*a* and 63*b* are apart from stationary contacts 12*a* and 13*b*, and elastic arm 51 is pressured to projection 19*a* of base 10. As a voltage is applied to coil 26 for energization to produce magnetic fluxes cancelling the above-mentioned magnetic fluxes produced by permanent magnet, right-hand side end 32*b* of movable iron blade 30 is attracted to right-hand side magnetic pole 21*b* of iron core 21, and movable iron blade 30 swings around projection 31 representing a supporting point against magnetic fluxes of permanent magnet 22 to attract right-hand side end 32*b* of movable blade 30 to right-hand side magnetic pole 21*b* after breaking left-hand side end 32*a* of movable blade 30 from left-hand side magnetic pole 21*a* of iron core 21. Accordingly, after movable contacts 62*a* and 62*b* of movable contact blades 62 are separated from stationary contacts 11*a* and 13*a*, movable contacts 63*a* and 63*b* of movable blades 63 come into contact with stationary contacts 12*a* and 13*b* and elastic arm 52 is pressured to projection 19*b* of base 10.

Upon deenergizing the coil 26, movable iron blade 30 is returned to an original position by a resetting force based on spring forces of elastic arm 52 and movable contact blades 63 and left hand side magnetic pole 21*a* of iron core 21 having attraction area wider than that of right hand side magnetic pole 21*b* to change a contact state of left-hand side movable contacts 62*a* and 62*b* and right-hand side contacts 63*a* and 63*b* to their original positions.

According to this embodiment, movable contact blades 62 and 63 have plane U-shaped configurations employing a double break method and in comparison with a single break method, for instance, a contact distance between stationary contact 11*a* and movable contact 62*a* may be a half, so that a scale in height of the electromagnetic relay is decreased and the relay may be miniaturized.

The load spring 50 includes elastic arms 51 and 52 which are independently operated in operating and resetting modes, so that a desired load curve is easily obtained by selecting the arms and a S-shaped attraction force curve based on electromagnetic block 20 is easily matched with load curve of load spring 50 allowing a great free degree of design.

Figure 4:
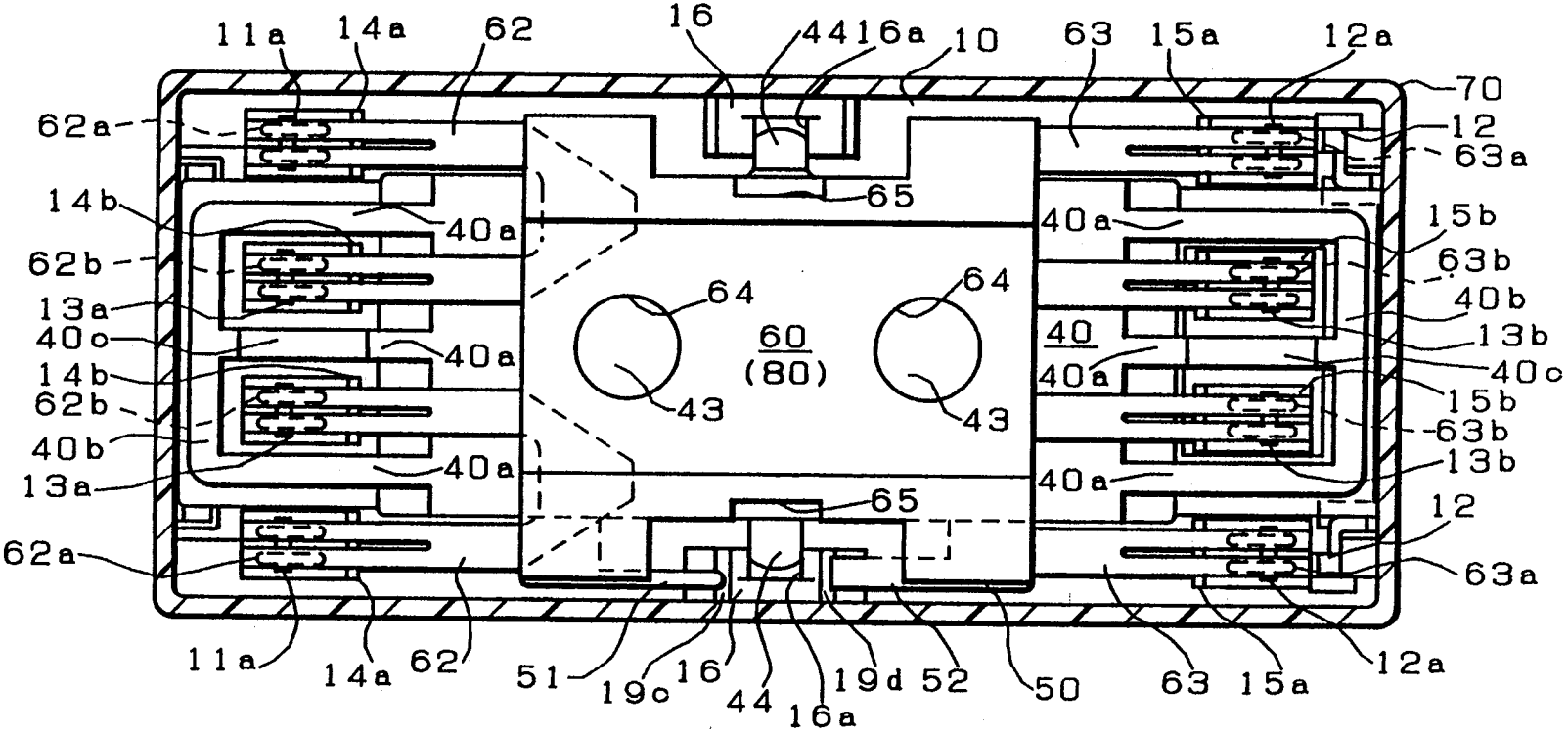
FIG. 4 is a plane sectional view of an electromagnetic relay as a second embodiment of this invention.
Figure 5:
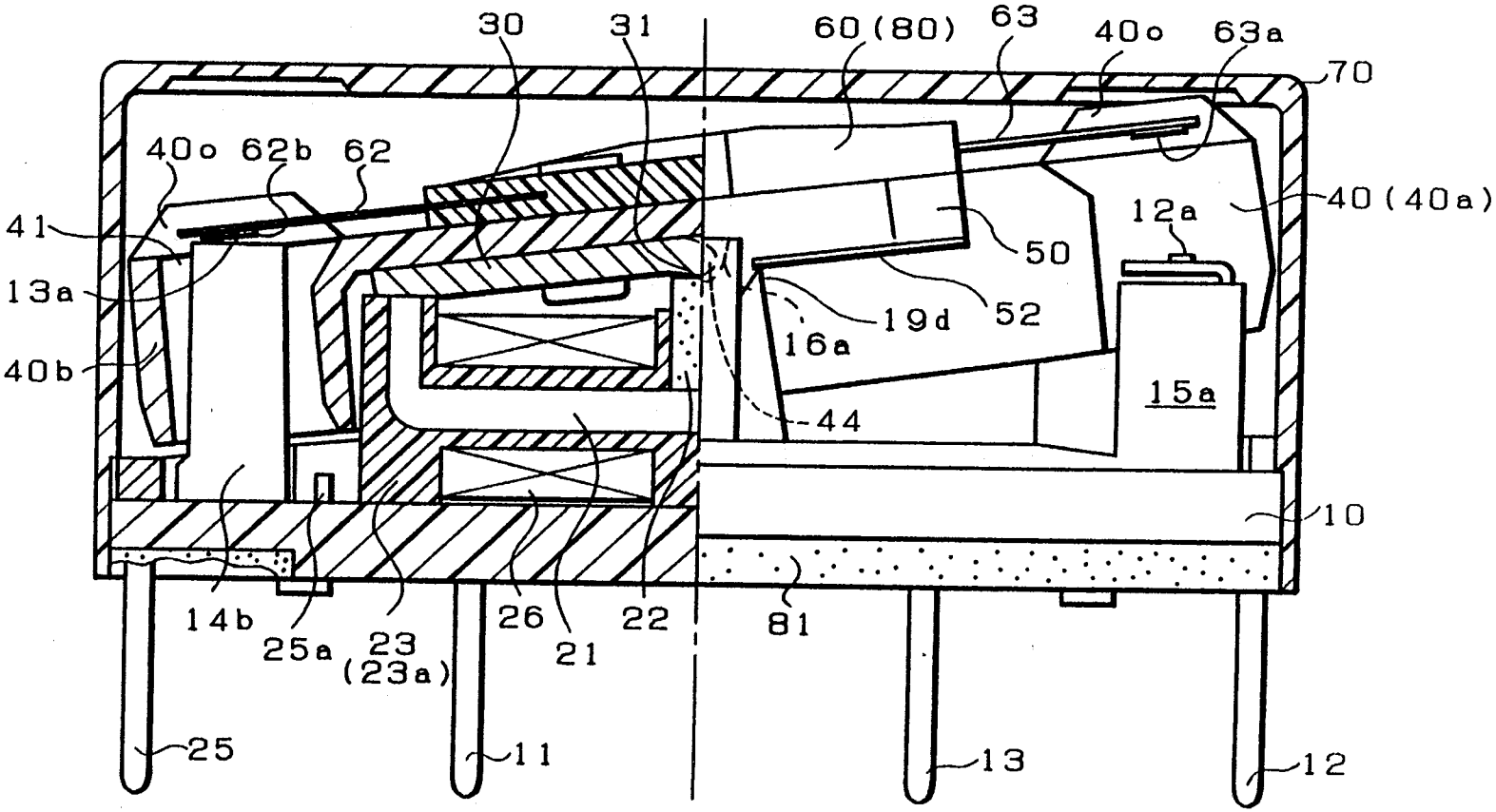
FIG. 5 is a front sectional view of the relay of FIG. 4.

In FIGS. 4 and 5 there is shown an electromagnetic relay as a second embodiment of this invention, which load spring 50 has a pair of confronting extending arms 51 and 52 though the arms 51 and 52 of the first embodiment are extending in the opposite directions. The arms 51 and 52 can be in contact with projections 19*c* and 19*d* near both sides of support 16. Other components are the same as those of the first embodiment, and its explanation will be omitted.

According to this second embodiment, the maximum deflection quantity of elastic arms 51 and 52 is small, and the rotation angle of insulating frame 40 also is small. Therefore, delicate adjustment is possible but a plate thickness of the load spring has to be relatively thick to get a large spring force. The thick load spring is, however, easily stamped out by press in comparison with a conventional thin plate spring. The elastic arms 51 and 52 are confronting each other, so that they do not pick anything in an assembling process and assembling the relay is simplified.

Figure 6:
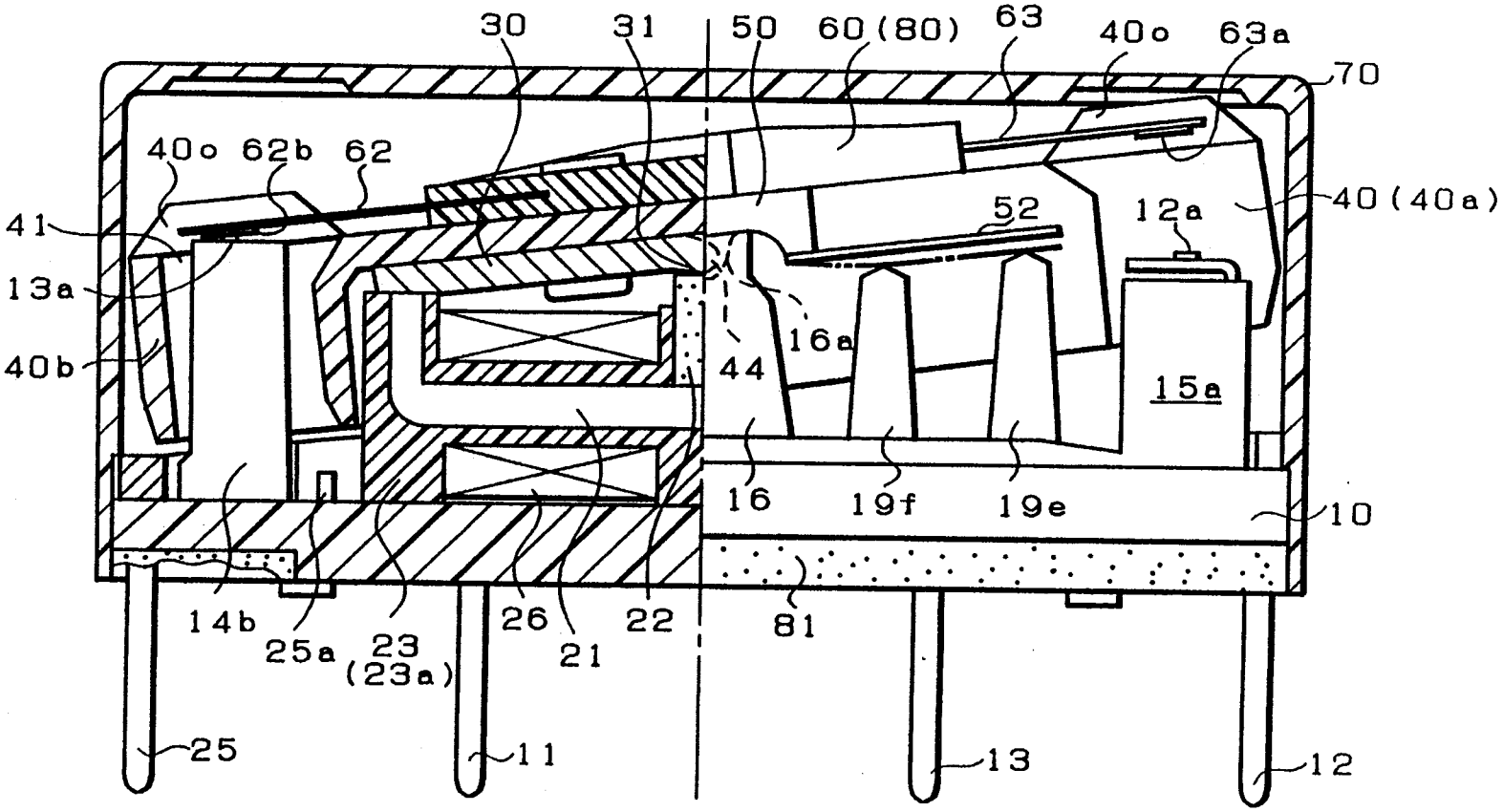
FIG. 6 is a front sectional view of an electromagnetic relay as a third embodiment of this invention.

In FIG. 6 there is shown an electromagnetic relay as a third embodiment of this invention, in which elastic arm 52 subsequently comes into contact with a plurality of projections 19*e* and 19*f* though one arm comes into contact with one projection in the above-mentioned embodiments. For simplified explanation, a pair of projection touched by elastic arm 51 are not shown in drawings.

According to this third embodiment the load curve of load spring 50 can have many bending portions to become close to the S-shaped attraction force curve with easy matching.

Figure 7:
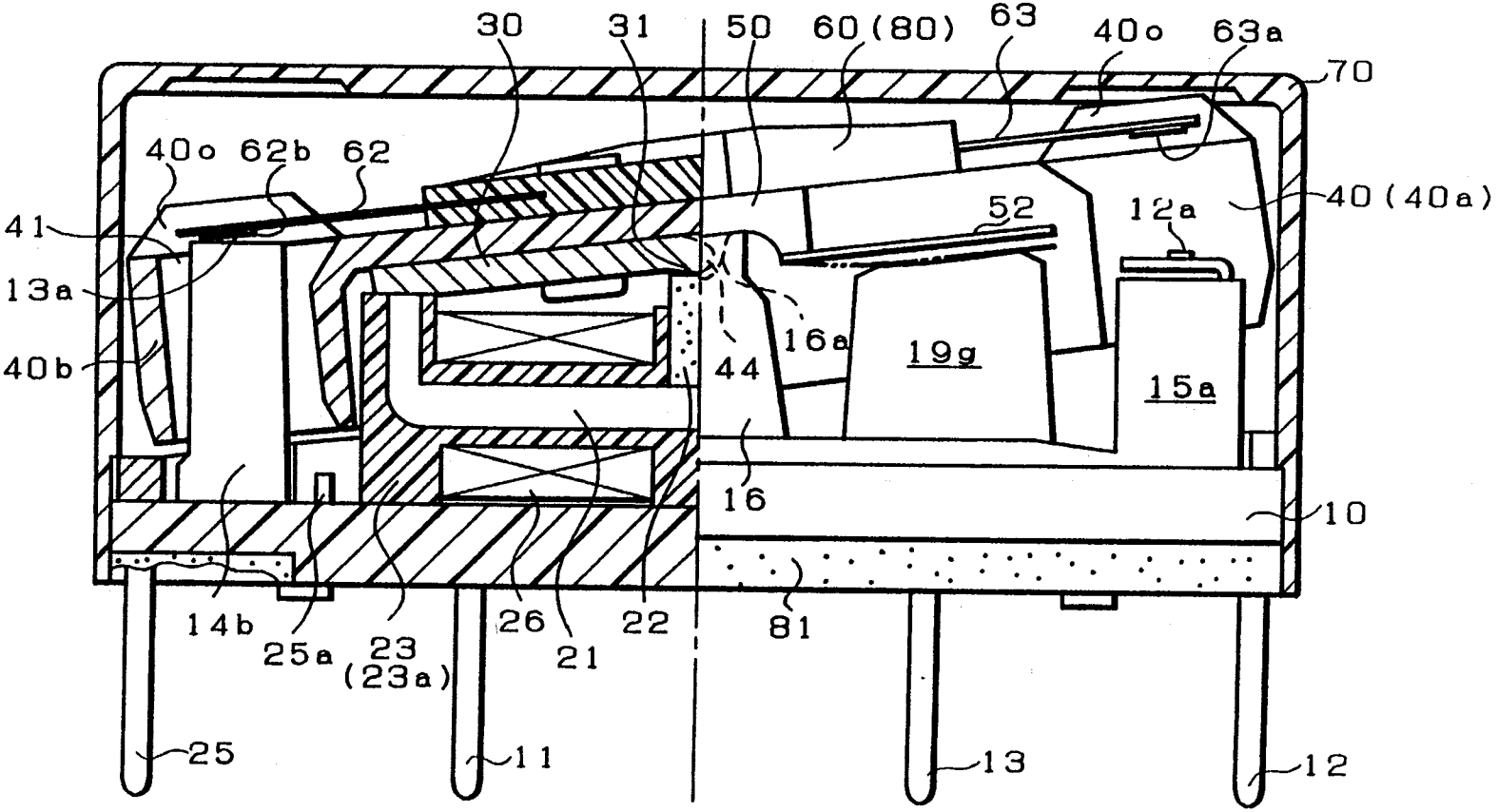
FIG. 7 is a front sectional view of an electromagnetic relay as a fourth embodiment of this invention.

In FIG. 7 there is shown an electromagnetic relay as a fourth embodiment of this invention, in which elastic arm 52 comes into contact with a projection 19*g* having a smooth curve on an upper end thereof though one elastic arm subsequently comes into contact with two projections in the second embodiment. In this embodiment a load curve of load spring 50 depicts a smooth curve so that the load curve can be easily matched with the attraction curve.

Figure 8:
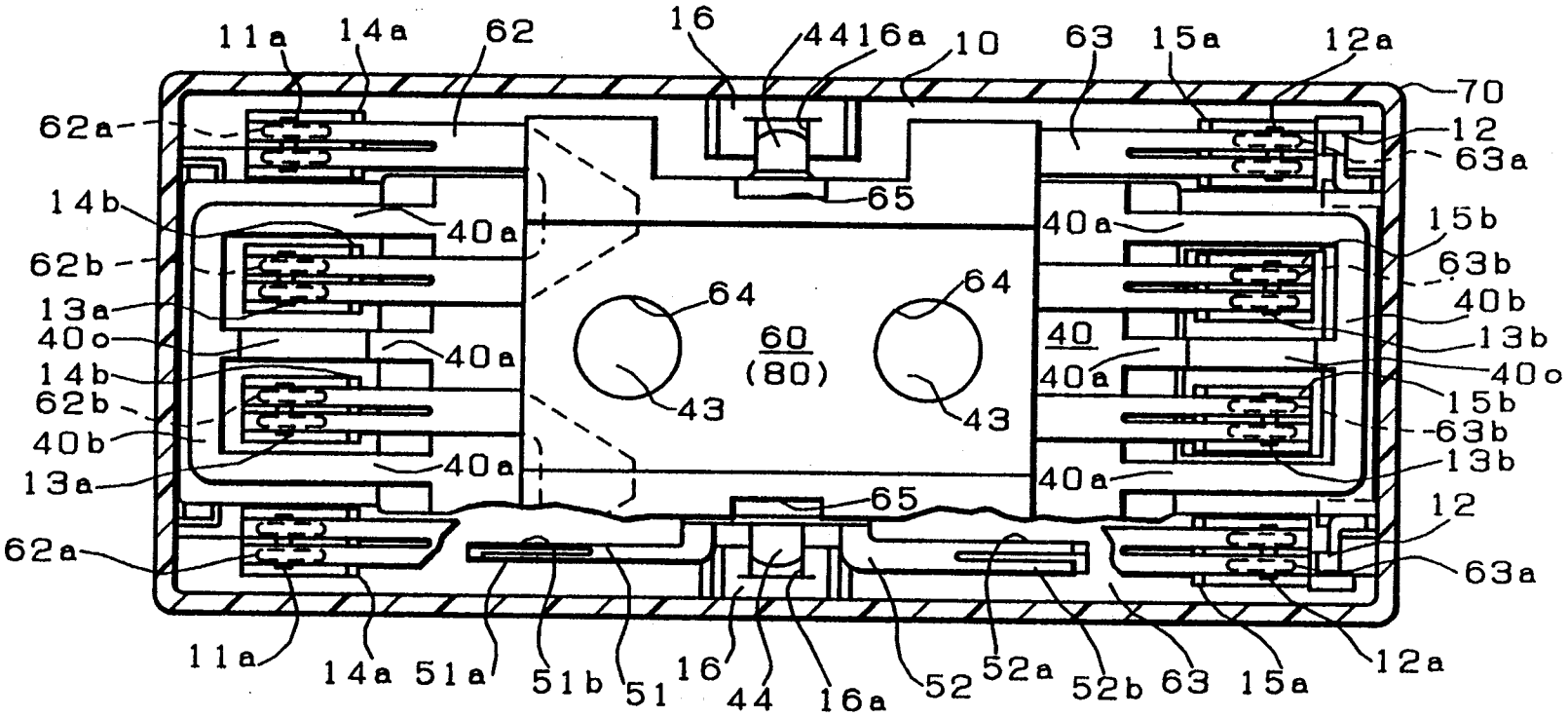
FIG. 8 is a plane sectional view of an electromagnetic relay as a fourth embodiment of this invention.
Figure 9:
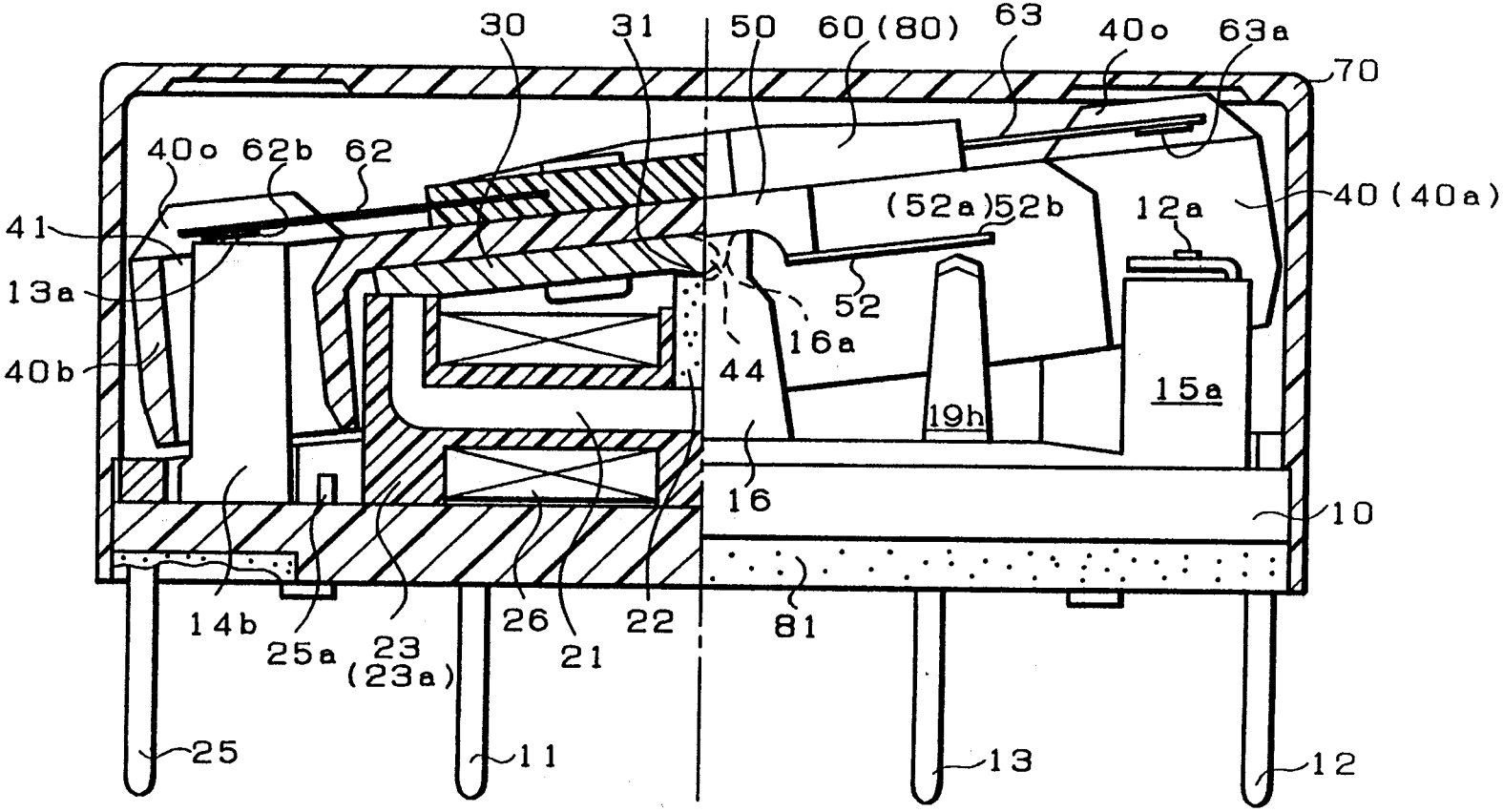
FIG. 9 is a front sectional view of an electromagnetic relay as a fifth embodiment of this invention.

In FIG. 8 there is shown an electromagnetic relay as a fifth embodiment of this invention, in which elastic arms 51 and 52 at their ends respectively have a pair of divisional leads 51*a*–51*b* and 52*a*–52*b* divided in a width direction. As shown in FIG. 9 the divisional leads 52*a* and 52*b* of elastic arm 52 are designed to contact stepped top wall of a projection 19*h* in a time shift fashion. This embodiment has an advantage that the load curve of load spring 50 has larger number of bent portions than those of the first and second embodiments and is possible to favorably match with attraction force curve of electromagnetic block 20. If desired, one of the pair of divisional leads 51*a* and 51*b* of arm 51 or one of the pair of divisional leads 52*a* and 52*b* of arm 52 is designed to be bent so as to contact one projection of base in a time shift fashion.

Figure 10:
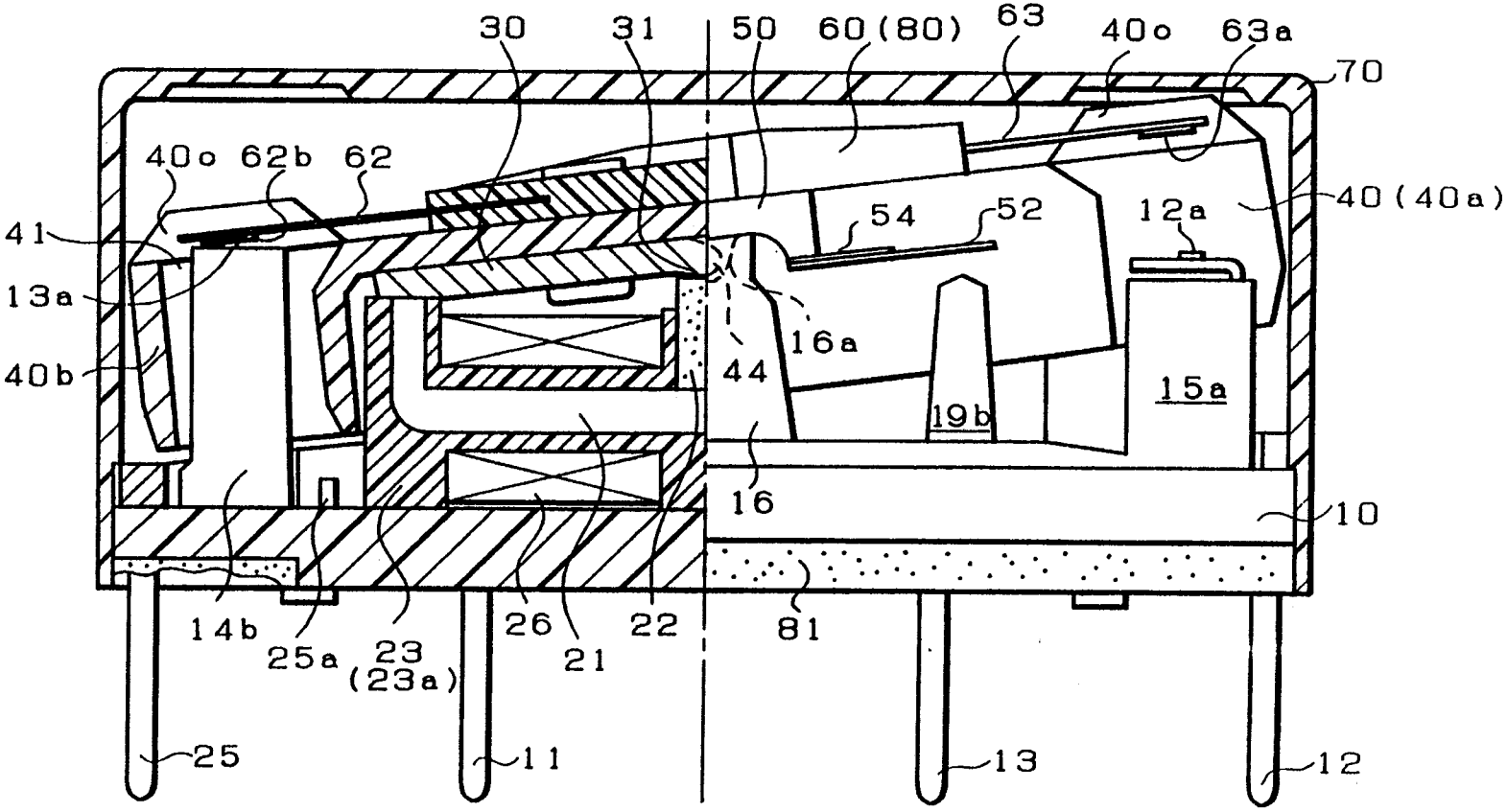
FIG. 10 is a front sectional view of an electromagnetic relay as a sixth embodiment of this invention.

In FIG. 10 there is shown an electromagnetic relay as a sixth embodiment of this invention, in which elastic arms 51 and 52 are provided with a reinforce spring 54 as a unified unit, whereby base ends of the elastic arms 51 and 52 are reinforced and their fatigue failure rarely happens so as to have a prolonged life. Moreover, the base ends of arms 51 and 52 are piled in double so that their damping time can be shortened, and the width scale of the arms can be decreased owing to the strengthened force to provide an electromagnetic relay having a reduced small bottom wall.

Figure 11:
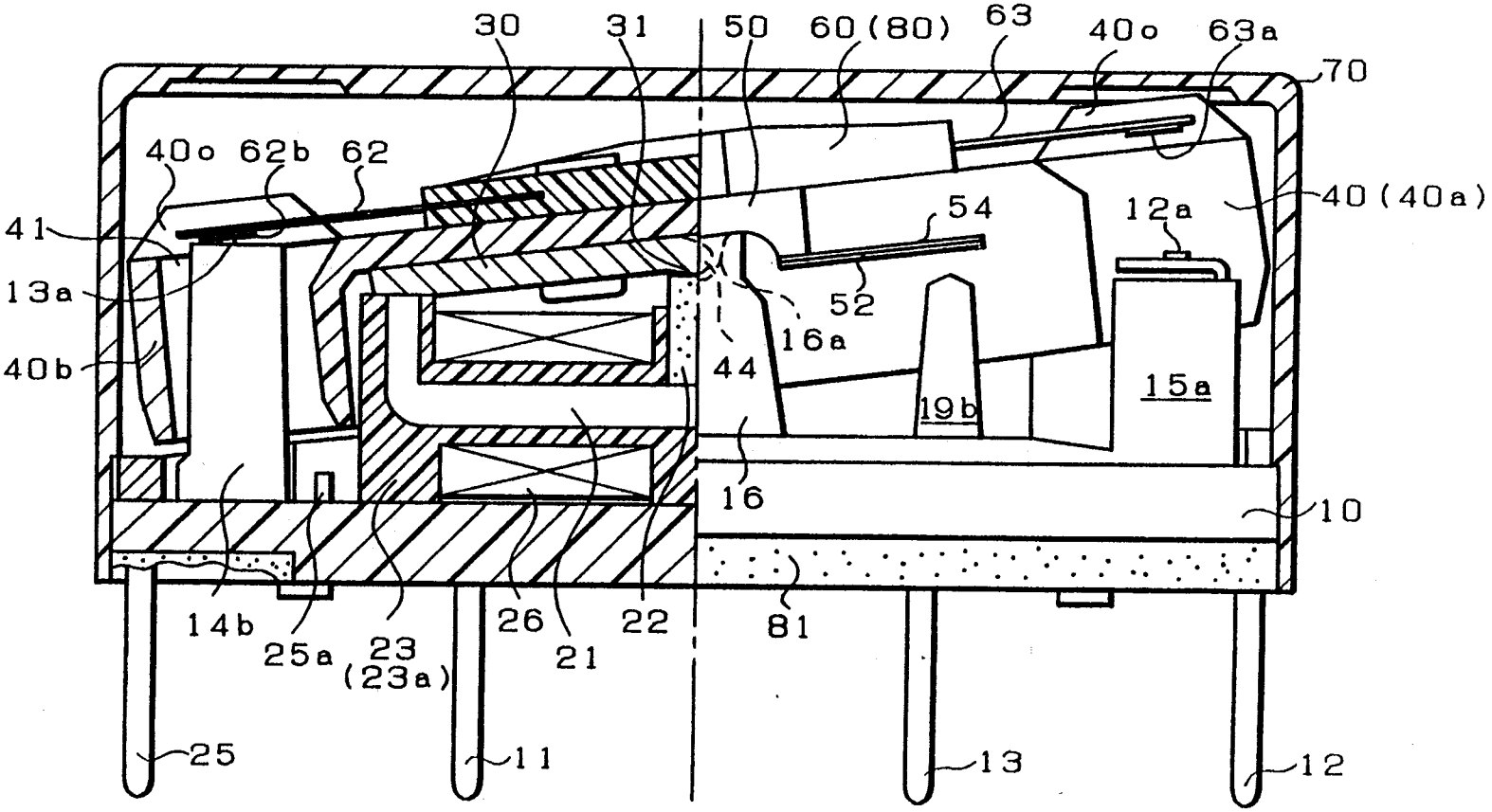
FIG. 11 is a front sectional view of an electromagnetic relay as a seventh embodiment of this invention.
Figure 12:
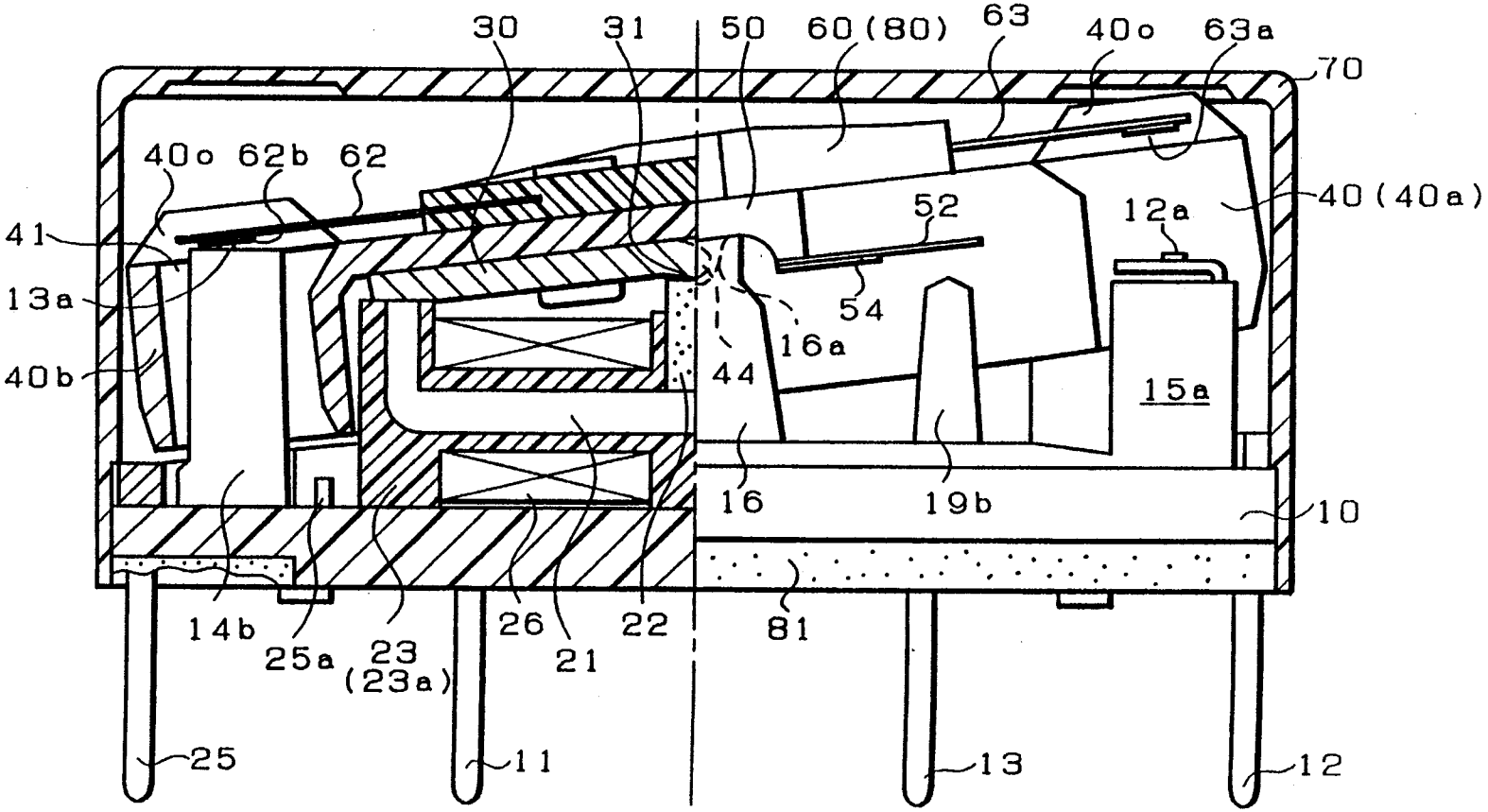
FIG. 12 is a front sectional view of an electromagnetic relay as a eighth embodiment of this invention.
Figure 13:
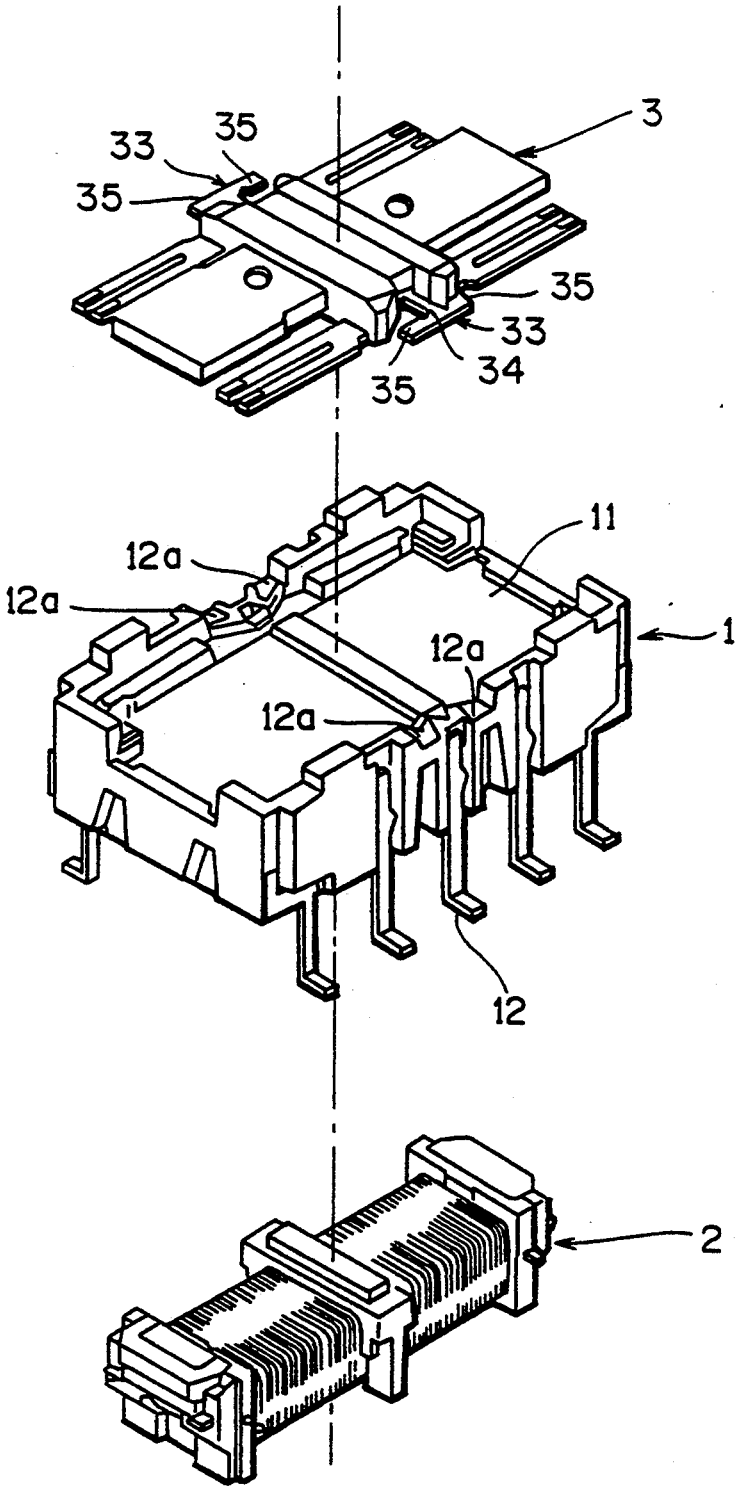
FIG. 13 (PRIOR ART)
FIG. 13 is a disassembled perspective view of a conventional electromagnetic relay.
Figure 14:
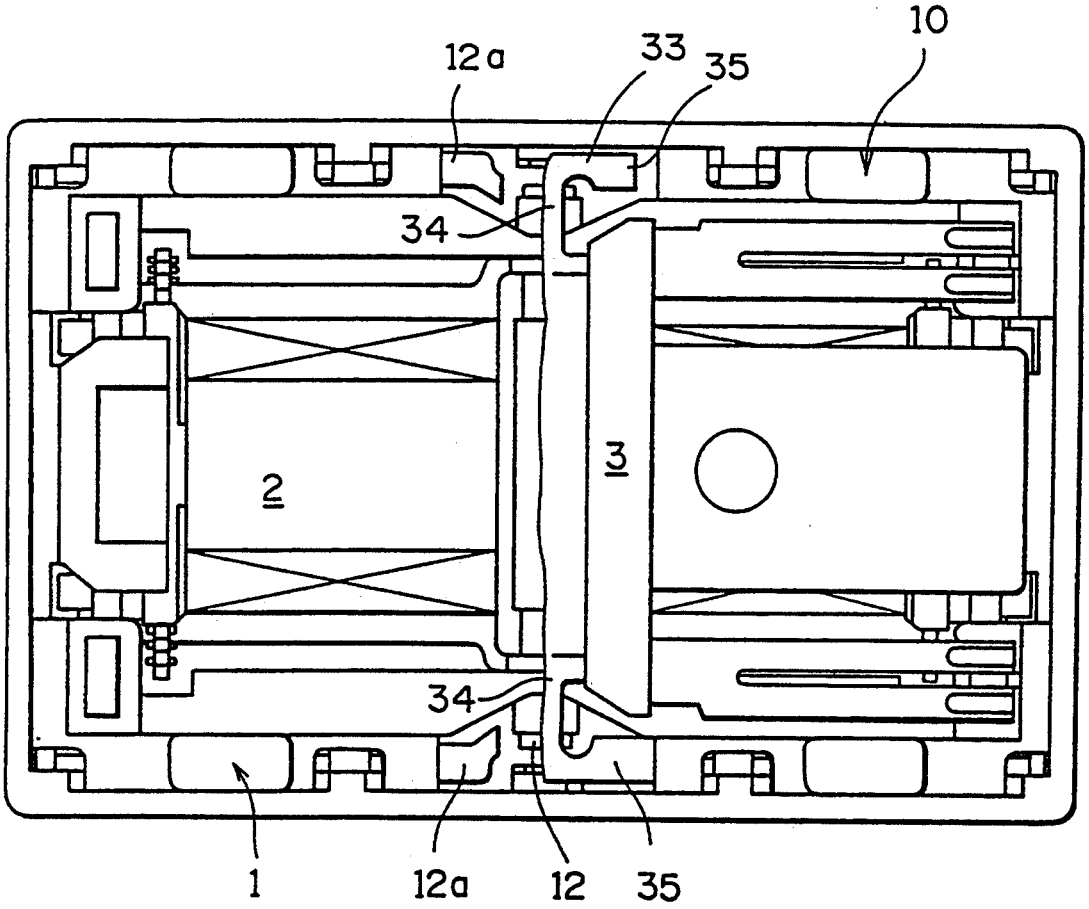
FIG. 14 (PRIOR ART)
FIG. 14 is a plane view of the relay of FIG. 13.

In order to prevent elastic arms 51 and 52 from fatigue failure, the arms, without being limited to the sixth embodiment, may be piled by a reinforcing spring 54 having a same shape as the arms as a seventh embodiment shown in FIG. 11 or may be jointed with reinforce spring 54 on a lower surface of the base ends of arms 51 and 52 as a unified unit as a eighth embodiment shown in FIG. 12. Though shafts 44 are formed with insulating frame 40 as a single mold unit in the foregoing embodiments, shafts of metal may be inserted into the mold by employing insert mold method. One end of the load spring 50 is not necessary too be fixed on the same side wall as that of the shafts 44, but may be fixed on other side wall. Other end of the load spring 50 is not necessary to be contact with base 10, but may be contact with other stationary component such as electromagnetic block 20.

Thus, according to the electromagnetic relay of this invention, the pair of shafts disposed on the movable block are designed to receive impact load to prevent the load spring from plastic deformation, so that the operational characteristics is not changed and operational malfunction is prevented.

The relay is assembled only by placing the movable block on the electromagnetic block disposed on the base, whereby the assembling is easy and the number of assembling is decreased, and productivity is improved.

Moreover, welding work is not required, so that dispersion of assembling accuracy and operational characteristics is prevented. Even if dispersion of operational characteristics is produced, adjustment work of operational characteristics may be simplified and the productivity can be improved because the movable block is easily removed from the base.

While there has been described above particular embodiments of an electromagnetic relay according to this invention for the purpose of enabling a person of ordinary skill in art to make and use this invention, it will be appreciated that this invention is not limited thereto. Accordingly, any modification, variation or equivalent arrangement within the scope of the attached claims should be considered to be within the scope of the invention.

What is claimed is:

1. An electromagnetic relay in which a movable block is mounted on an upper surface of an electromagnetic block disposed on a base for a swing movement and contacts are switched by the movable block being energized and deenergized, comprising a pair of supports projecting on an upper surface of the base which are opposed with respect to the electromagnetic block, a pair of shafts projecting from both opposite side walls of said movable block to be engaged with said supports, and a load spring fixed to said movable block.

2. An electromagnetic relay according to claim 1 in which one end of said load spring is fixed to said movable block and other end of said load spring includes a pair of elastic arms extending in opposite directions.

3. An electromagnetic relay according to claim 1 in which one end of said load spring is fixed to said movable block and other end of said load spring includes a pair of elastic arms extending in confronting directions.

4. An electromagnetic relay according to one of claims 1 to 3 in which said load spring is adapted to subsequently contact a plurality of projections different in height which project from said stationary portion.

5. An electromagnetic relay according to one of claims 1 to 3 in which said load spring is adapted to subsequently contact a curved surface formed on a top end of a projection projecting form said stationary portion.

6. An electromagnetic relay according to one of claims 1 to 3 in which other end of said load spring consists of divisional leads divided in a width direction which subsequently come into contact with the respective heads of a projection having steps which stands on the upper surface of said stationary portion.

7. An electromagnetic relay according to one of claims 1 to 6 in which at least base portion of elastic arms of said load spring which are elastically deformed has a piled construction in double.

8. An electromagnetic relay according to claim 1, further comprising a pair of spring receiving projections disposed between said pair of supports.

9. An electromagnetic relay according to claim 1, wherein said load spring is structured and arranged to contact said pair of spring receiving projections.

* * * * *